US009206686B2

(12) United States Patent
Ball et al.

(10) Patent No.: US 9,206,686 B2
(45) Date of Patent: Dec. 8, 2015

(54) CUTTER TOOL

(75) Inventors: Brett Ball, Doncaster (GB); Philip Nigel Moore, Doncaster (GB); William Stephen Clapham, Barnsley (GB)

(73) Assignee: ESCO HYDRA (UK) LIMITED (GB)

( * ) Notice: Subject to any disclaimer, the term of this patent is extended or adjusted under 35 U.S.C. 154(b) by 0 days.

(21) Appl. No.: 14/150,517

(22) PCT Filed: Aug. 8, 2012

(86) PCT No.: PCT/IB2012/001988

§ 371 (c)(1),
(2), (4) Date: Aug. 8, 2014

(87) PCT Pub. No.: WO2013/021283

PCT Pub. Date: Feb. 14, 2013

(65) Prior Publication Data

US 2015/0028655 A1 Jan. 29, 2015

(30) Foreign Application Priority Data

Aug. 8, 2011 (GB) ..... 1113591.0

(51) Int. Cl.

| | |
|---|---|
| ***E21C 35/18*** | (2006.01) |
| ***E21C 35/19*** | (2006.01) |
| ***E21C 35/183*** | (2006.01) |

(52) U.S. Cl.

CPC ..... *E21C 35/18* (2013.01); *E21C 35/183* (2013.01); *E21C 35/19* (2013.01)

(58) Field of Classification Search

CPC ..... E21C 35/193; E21C 35/1936
USPC ..... 299/102, 103, 108, 109, 112 R
See application file for complete search history.

(56) References Cited

U.S. PATENT DOCUMENTS

| | | | | |
|---|---|---|---|---|
| 2,860,863 | A | 11/1958 | Bruestle et al. | |
| 2,965,365 | A | 12/1960 | Krekeler | |
| 3,092,374 | A | 6/1963 | Krekeler | |
| 3,114,537 | A | 12/1963 | Krekeler | |
| 3,223,452 | A | 12/1965 | Krekeler | |
| 3,256,043 | A | 6/1966 | Krekeler | |
| 3,275,376 | A * | 9/1966 | Prox, Jr. | 299/109 |
| 3,342,531 | A * | 9/1967 | Krekeler | 299/107 |
| 3,805,423 | A | 4/1974 | Engel et al. | |
| 3,814,482 | A | 6/1974 | Bower et al. | |
| 3,834,764 | A | 9/1974 | Krekeler | |
| 3,856,358 | A | 12/1974 | Krekeler | |

(Continued)

FOREIGN PATENT DOCUMENTS

| | | |
|---|---|---|
| GB | 1238838 | 7/1971 |
| GB | 2068435 | 8/1981 |

(Continued)

*Primary Examiner* — David Bagnell
*Assistant Examiner* — Michael Goodwin
(74) *Attorney, Agent, or Firm* — Steven P. Schad

(57) ABSTRACT

A cutter tool that includes a shank by which the tool is releasably retainable within a tool holder, an enlarged shoulder or heel provided at one end of the shank and adapted, in use, to abut a seating surface of a tool holder and limit the penetration of the tool holder into a receiving aperture of the tool holder, and an integral blade provided beyond the enlarged shoulder or heel and terminating in a carbide or other tip. The tool is provided with a zone of weakness such that if subjected to fracture forces, a fracture will be encouraged to propagate from the zone of weakness in a particular desired manner.

8 Claims, 2 Drawing Sheets

(56) References Cited

U.S. PATENT DOCUMENTS

| | | | | |
|---|---|---|---|---|
| 4,027,409 | A | 6/1977 | Stepe | |
| 4,057,294 | A * | 11/1977 | Krekeler | 299/102 |
| 4,143,920 | A | 3/1979 | Haddock | |
| 4,274,677 | A | 6/1981 | Proctor | |
| 4,298,233 | A | 11/1981 | Elfgen | |
| 4,480,874 | A | 11/1984 | Shaw | |
| 4,542,943 | A | 9/1985 | Montgomery | |
| 4,657,308 | A | 4/1987 | Claphan | |
| 4,913,125 | A | 4/1990 | Bunting et al. | |
| 5,235,961 | A | 8/1993 | McShannon | |
| 5,297,853 | A | 3/1994 | Sollami | |
| 5,374,111 | A | 12/1994 | Den Besten et al. | |
| 5,503,463 | A | 4/1996 | Ojanen | |
| 5,551,760 | A | 9/1996 | Sollami | |
| 5,573,308 | A | 11/1996 | Simons et al. | |
| 5,683,144 | A | 11/1997 | Kammerer et al. | |
| 6,086,160 | A | 7/2000 | Bitelli | |
| 6,176,552 | B1 | 1/2001 | Topka et al. | |
| 6,234,579 | B1 | 5/2001 | Montgomery | |
| 6,244,665 | B1 | 6/2001 | Bise et al. | |
| 6,331,035 | B1 | 12/2001 | Montgomery | |
| 6,341,823 | B1 | 1/2002 | Sollami | |
| 6,364,420 | B1 | 4/2002 | Sollami | |
| 6,585,326 | B2 | 7/2003 | Sollami | |
| 6,786,557 | B2 | 9/2004 | Montgomery | |
| 7,210,744 | B2 | 5/2007 | Montgomery | |
| 7,360,845 | B2 | 4/2008 | Ojanen | |
| 7,458,646 | B2 | 12/2008 | Marathe et al. | |
| 7,490,912 | B2 | 2/2009 | Holl | |
| 7,832,809 | B2 | 11/2010 | Hall et al. | |
| 7,946,657 | B2 | 5/2011 | Hall et al. | |
| 7,950,745 | B2 | 5/2011 | Sollami | |
| 2002/0167216 | A1 | 11/2002 | Sollami | |
| 2003/0015907 | A1 | 1/2003 | Sollami | |
| 2008/0035383 | A1 * | 2/2008 | Hall et al. | 175/414 |
| 2011/0109147 | A1 | 5/2011 | Monyak et al. | |
| 2012/0001475 | A1 | 1/2012 | Dubay et al. | |
| 2012/0146391 | A1 | 6/2012 | Hall et al. | |
| 2012/0181845 | A1 | 7/2012 | Sollami | |
| 2013/0076102 | A1 * | 3/2013 | Pizzato et al. | 299/79.1 |

FOREIGN PATENT DOCUMENTS

| | | |
|---|---|---|
| GB | 2290324 | 12/1995 |
| GB | 2299354 | 10/1996 |

* cited by examiner

PICK WITH
NOTCH IN SHANK

PICK WITH NOTCH IN SHANK

PICK WITH NOTCH IN BLADE

CUTTER TOOL

PRIORITY

This Application claims the benefit of British Application Serial No. 1113591.0 filed 8 Aug. 2011.

FIELD OF THE INVENTION

This invention relates to a cutter tool, primarily for use in mineral winning, such as coal mining, but also useable for other underground purposes such as tunnel or roadway driving, or above ground for civil engineering works, road planing, trench cutting, whether with drums or endless chains, both on land and sub-sea.

BACKGROUND OF THE INVENTION

In coal and other kinds of mining by the longwall technique, it is conventional to provide steel roof supports either as components of a series of hydraulically powered roof supports extending along, and advanceable with, the mineral face as the latter is extracted, or permanent supports in the form of rings or arches at roadways that are conventionally provided at each end of a longwall face.

Mineral is removed by a single or double ended ranging drum shearer, which traverses the mineral face, with a rotary cutting head carried by the, or each, ranging arm to follow the seam, each drum being provided with 50-100 cutter tools, each having a shank by which each tool is replaceably located in a tool holder.

However, despite the best efforts of the operatives, the drums, and specifically the tools, frequently strike a steel roof bar, or hard inclusions in the roof or floor of the mineral seam, and the tool is fractured—typically its head or blade, is sheared from its shank.

Tools need regular replacement, and removal of a broken or damaged tool is frequently difficult or sometimes impossible, such that removal cannot be effected until the drum is eventually taken to the surface, or a safe underground area, for refurbishment.

In civil engineering works, the tool may strike an unknown buried obstruction such as concrete reinforcement bar, a steel railway line, etc.

OBJECT OF THE INVENTION

A basic object of the present invention is the provision of an improved cutter tool.

SUMMARY OF THE INVENTION

According to the present invention there is provided a cutter tool comprising a shank by which the tool is releasably retainable within a tool holder, an enlarged shoulder(s) or heel(s) provided at one end of the shank and adapted, in use, to abut a seating surface of a tool holder and hence to limit the penetration of the tool into a receiving aperture of the tool holder, and an integral blade provided beyond the enlarged shoulder(s) or heel(s) and terminating in a carbide or other tip. The tool is provided with a zone of weakness such that if subjected to fracture forces, a fracture will be encouraged to propagate from the zone of weakness in a particular desired manner.

The zone of weakness needs to be such that the normal, e.g. mineral winning, operation of the tool is not impaired, but the tool will fracture in the manner desired when the tool is overloaded by striking, for example, a steel support. However, as the inadvertent striking of e.g. a steel member of some form or other is largely unavoidable, the provision of a zone of weakness and thus the management of the zone of fracture, ensures that the residual portion of a broken tool is easier to extract in underground conditions, than would otherwise be the case.

In one aspect, a cutter tool in accordance with the present invention includes a shank releasably retainable within an aperture in a tool holder, and a head to contact the material to be engaged during use. The head is provided at one end of the shank to abut a seating surface of a tool holder and limit the penetration of the cutter tool into the aperture of the tool holder. The cutter tool has a front surface that faces in the direction of travel during use, an opposite rear surface, and side surfaces that connect the front and rear surfaces. A slot opens only in the front surface and in the side surfaces to the depth of the slot to define a frangible portion. The frangible portion remains intact during normal operations. However, when the cutter tool is subjected to fracture forces, a fracture will be encouraged to propagate from the slot through the frangible portion.

In another aspect, a cutter tool in accordance with the invention includes a shank releasably retainable within an aperture in a tool holder, and a head to contact the material to be engaged during use. The head is provided at one end of the shank to abut a seating surface of a tool holder and limit the penetration of the cutter tool into the aperture of the tool holder. The tool includes a zone of weakness to define a frangible portion that, in relation to the expected striking force, has less strength than the interface between the head and the shank in relation to the expected striking force such that when the cutter tool is subjected to fracture forces, a fracture will be encouraged to propagate through the frangible portion.

In another aspect of the invention, a cutter tool includes a shank releasably retainable within an aperture in a tool holder, and a head to contact the material to be engaged during use. The head is larger than the shank and provided at one end of the shank so as to define an interface between the shank and the head. The head abuts a seating surface of the tool holder and limits the penetration of the cutter tool into the aperture of the tool holder. A zone of weakness is provided at the interface between the shank and the head such that when the cutter tool strikes a hard member a fracture will be encouraged to propagate through that interface.

The zone of weakness is preferably provided by a slot (e.g., a slit or groove cut or forged) formed into the tool to provide a frangible portion within the tool, but could be provided by other means.

BRIEF DESCRIPTION OF THE DRAWINGS

In all three figures, like components are accorded like reference numerals.

DETAILED DESCRIPTION OF THE PREFERRED EMBODIMENTS

Figure 1:
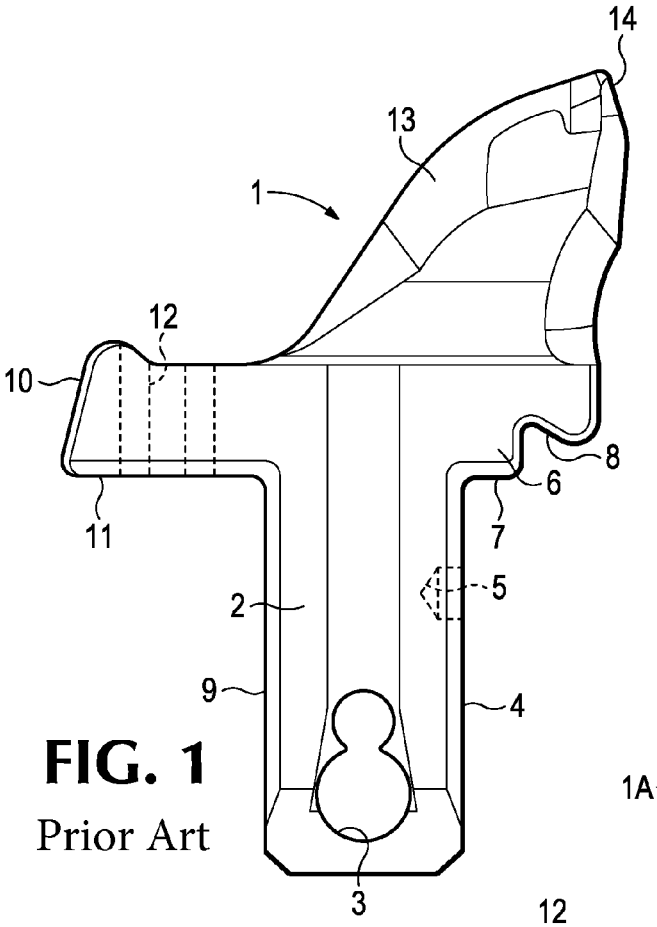
FIG. 1 Prior Art
FIG. 1 is a side elevation of one of Applicant's prior art, standard shearer tools.

In FIG. 1 is illustrated a typical shearer pick 1 in common use, worldwide, comprising a non-circular shank 2 adapted to be releasably located within a corresponding aperture in a tool holder or pick box, and releasably retained against inadvertent loss by a latching means, such as a multi-ribbed, synthetic plastics insert in the double "O" aperture 3. At a front or leading face 4 of the shank 2 is provided a blind aperture 5 to receive an additional, or alternative, resilient, shank retaining button (not shown). From the upper end of the front face 4 of the shank 2 a forwardly directed enlarged shoulder 6 extends having an underside 7 to seat on a support surface (not shown) of the associated tool holder or pick box in the well known manner. Further forward, the shoulder 6 is provided with a notch 8 for engagement by an extraction tool, such as a screwdriver or drift, when extraction of the pick 1 is required. At a trailing face side 9 of the shank 2 is provided a heel 10 also having a support surface 11, and in addition a through hole 12 to accommodate a portion of a water spray nozzle (not shown). Beyond the shoulder 6 and heel 10 extends an integral blade 13 provided with a carbide tip 14. Shoulder 6, heel 10 and blade 13 comprise the head 22 of the cutter tool 1.

In accordance with a first embodiment of the invention, a slot 15 is provided in cutter tool 1A at a 90° junction between the leading face 4 of the shank 2 and a portion 16 of the enlarged shoulder 6. In this embodiment, the slot 15 extends at a 45° angle to the front face 40 of shank 2 and to the underside surface 7 of shoulder 6. Slot 15 is provided to influence that the cutting tool 1 will break the head 22 from the shank 2 so that the shank can be removed downward when used in a tool holder that provides a removal opening such as disclosed in British Application Serial No. 1113669.4 field Aug. 9, 2011.

Figure 2:
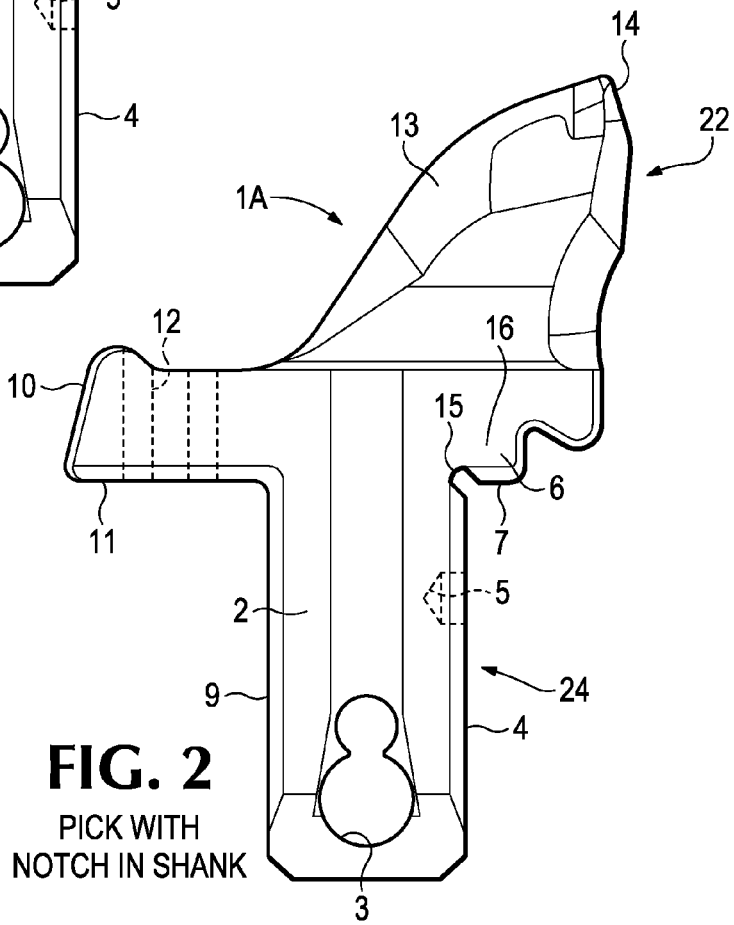
FIG. 2 corresponds to FIG. 1, but shows in accordance with one aspect of the invention, a slot provided at the junction between a forward face of the shank, and the forwardly extending, enlarged shoulder.
Figure 2A:
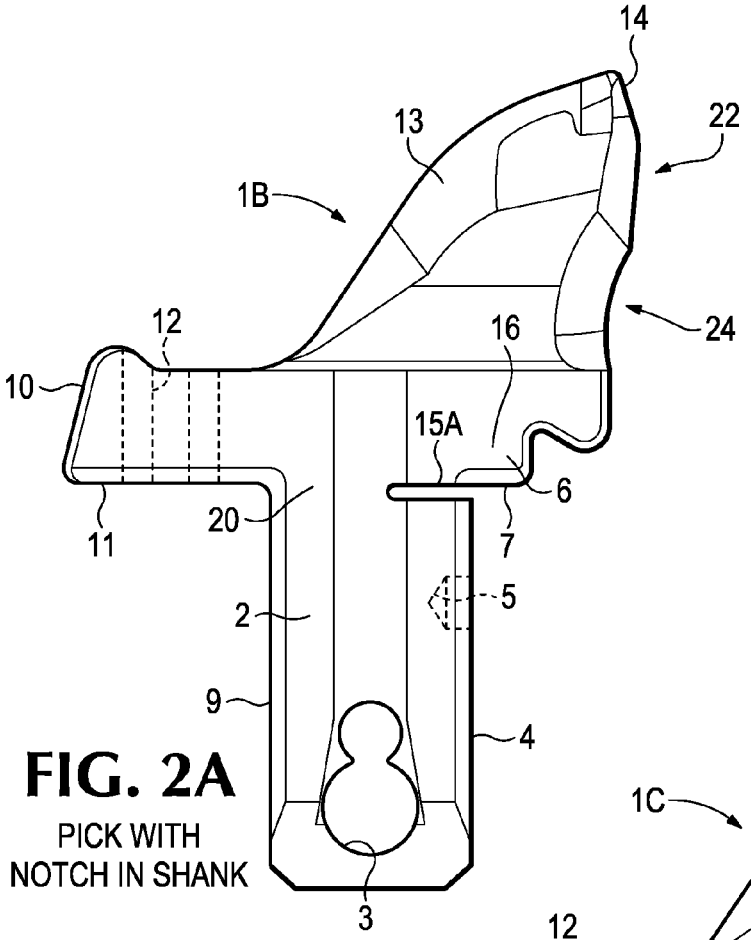
FIG. 2A shows a second embodiment of a cutter tool with slot at the junction between a forward face of the shank and the forwardly extending enlarged shoulder.

FIG. 2A discloses a preferred slot formation at the junction between the shank and the shoulder. In this embodiment, slot 15A extends inward at the junction along the top of shank 4 to define a frangible portion 20 that is sufficiently robust to withstand normal operation, but will break when the cutter tool 1B strikes a steel member or other hard object. The provision of slot 15A dictates that the cutter tool when striking a steel member will, in most cases, break cleanly along the top of the shank without bending or distorting the shank 2 or leaving a portion of head 22 remaining connected to the shank. An unbent shank can be easily tapped downward and out of the tool holder for tool holders with a lower removal opening such as disclosed in British Application Serial No. 1113669.4 filed Aug. 9, 2011.

Slot 15A extends from a front surface 24 of the cutter tool 1B. In one preferred embodiment, slot 15A extends perpendicular to front face 4 and opens only in the front surface (i.e., in the direction the tool is driven during operation) of the cutting tool, which in this embodiment is the front face 4 of shank 2, and in the sides to its depth of extension into the tool from the front face 4 in order to more effectively provide a clean break without distortion of the part remaining in the tool holder; i.e., it is considered beneficial for directing a clean fracture for the slot to open only or primarily in the surface which receives the primary loading. Slot 15A defines a frangible portion 20 in the remaining thickness of the material. Frangible portion 20 is formed to resist normal loading and remain intact during normal operation of the cutter tool, and to provide a clean break of the head 22 from the shank 2 without distortion of the shank when a steel member or other hard object (e.g., a steel member) is struck. The minimum and maximum thickness will be determined based on the intended application as well as the design and material of the cutter tool.

As stated previously, a not uncommon occurrence is for the blade 13 to strike a steel obstruction, such as a roof support bar, or buried tramway rail or pipeline. In this situation, the provision of the slot 15 or 15A is aimed at propagating a break from the slot to completely separate the head 22 from the shank 2 without distorting the shank for easier removal of the shank from the tool holder.

Figure 3:
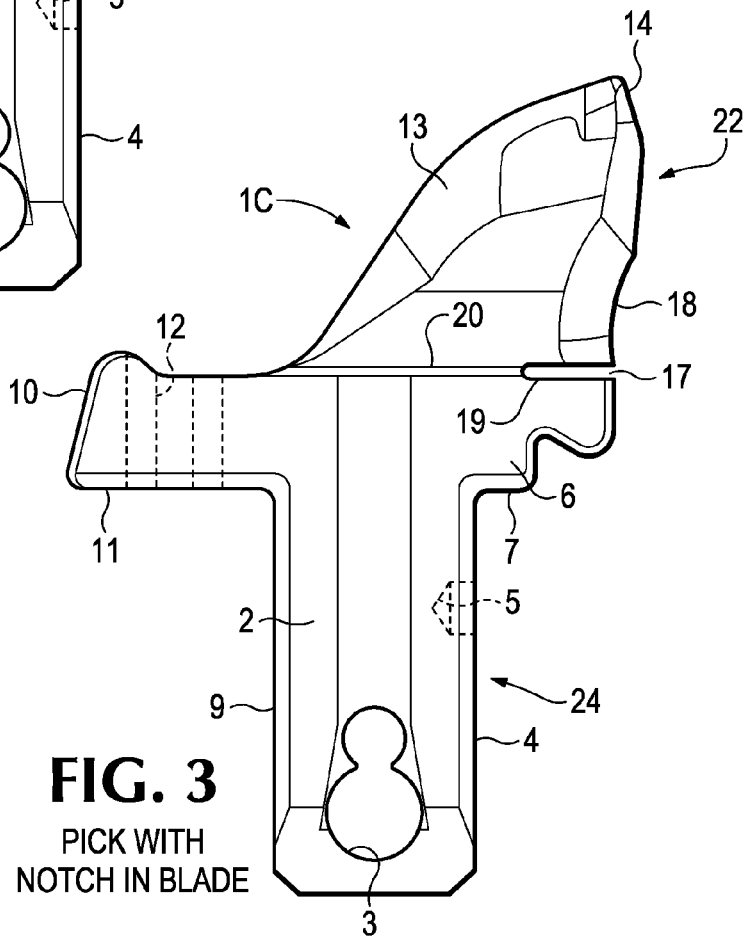
FIG. 3 also corresponds to FIG. 1, but shows in accordance with another aspect of the invention, a slot provided at the junction between a base of the front face of the blade, and the forwardly extending, enlarged shoulder.

In another embodiment illustrated in FIG. 3, a slot 17 is provided in a front face 18 of the blade 13 in a zone 19 where the blade 13 meets the enlarged shoulder 6. As with the earlier embodiments, the slot 17 preferably opens only in the front face of the cutting tool, which in this case is the front face 18 of blade 13, and in the sides to the depth of the slot into the head 22. As with the earlier embodiment, the slot forms a frangible portion 20 having a certain thickness. The frangible portion 20 has a certain "dynamic strength," which is defined as the force required to break the frangible portion when the force is an impact load applied to the tip of the cutter tool. The dynamic strength of the frangible portion is, then, a factor of (i) the cross sectional size of the frangible portion where the break is intended (typically the most narrow cross section), (ii) material of the cutter tool at this cross section frangible portion, and (iii) the vertical distance between the frangible portion and the tip where the impact load is applied during use.

In accordance with this one aspect of invention, the dynamic strength of the frangible portion 20 is less or weaker than the dynamic strength of the interface between the head 22 and the shank 2. In a preferred embodiment, the dynamic strength of the frangible portion is at least about ten percent less than the dynamic strength of the interface between the shank and the head in order to reliably (i.e., in most cases) direct the breaking of the cutter tool along the frangible portion rather than the shank-head interface when the cutter tool strikes a steel member or other hard member. In this way the shoulder 6 and removal notch 8 are preserved even if a steel member is struck by the tip 14 of the cutter tool to enable removal of the shank 2 from the tool holder so that a replacement cutter tool can be inserted. The dynamic strength of the frangible portion could be much less than 10% weaker than the shank-head interface so long as the frangible portion remained intact during normal operation.

In alternative constructions (not shown), a zone of weakness or frangible portion can be defined by means other than a slot defined in the cutter tool. In addition, other kinds of slots can be used even though they are formed in ways other than disclosed above. For example, a slot can be formed around the periphery or by being partially formed in both the front and the rear surface. In these alternative slot constructions, the slot is preferably primarily formed to extend from the front surface, i.e., that the majority of the depth of the slot extends from the front surface. The slots 15, 15A, 17 are shown as narrow and linear gaps in the cutter tool, which is the preferred construction. Nevertheless, the slots could have a non-linear configuration, have a wider (not narrow) width, and/or have an irregular shape. The term "slot" is intended to have a broad construction to define a gap in the cutter tool having a wide variety of possible shapes. The shape or size of the opening can vary considerably.

What we claim is:

1. A cutter tool for attachment to an excavating machine for working a material to be excavated, the cutter tool comprising a shank releasably retainable within an aperture in a tool holder mounted on the excavating machine, a head for contacting the material to be engaged during use, the head being fixed at one end of the shank to define an interface between the shank and the head, the head having a shoulder to limit the penetration of the cutter tool into the aperture of the tool holder, and a zone of weakness at the interface between the shank and the head such that when the cutter tool is subjected to fracture forces a fracture will be encouraged to propagate through that interface and the head broken from the shank.

2. A tool as claimed in claim 1, wherein the zone of weakness is defined by a slot formed in the tool at the interface between the shank and the head.

3. A tool as claimed in claim 2, wherein the shank has a longitudinal axis, and the slot extends in a direction perpendicular to the longitudinal axis.

4. A cutter tool for attachment to an excavating machine for working a material to be excavated, the cutter tool comprising a shank releasably retainable within an aperture in a tool holder mounted on the excavating machine, a head for contacting the material to be engaged during use, the head being fixed at one end of the shank, the head having a shoulder to limit the penetration of the cutter tool into the aperture of the tool holder, and a zone of weakness such that when the cutter tool is subjected to fracture forces a fracture will be encouraged to propagate through the zone of weakness and the shoulder be broken from a portion of the shank.

5. A tool as claimed in claim 4, wherein the zone of weakness in the tool is at an interface between the shank and the head.

6. A tool as claimed in claim 4, wherein the zone of weakness is defined by a slot formed in the tool at an interface between the shank and the head.

7. A tool as claimed in claim 4, wherein the shank has a longitudinal axis, and the slot extends in a direction perpendicular to the longitudinal axis.

8. A tool as claimed in claim 4 which has a front surface, a rear surface and side surfaces, wherein the front surface faces in a direction of travel when in operation, and the zone of weakness is defined by a slot that opens only in the front surface and in the side surfaces to the depth of the slot.

* * * * *